US006670605B1

(12) United States Patent
Storm, Jr. et al.

(10) Patent No.: US 6,670,605 B1
(45) Date of Patent: Dec. 30, 2003

(54) METHOD AND APPARATUS FOR THE DOWN-HOLE CHARACTERIZATION OF FORMATION FLUIDS

(75) Inventors: Bruce H. Storm, Jr., Houston, TX (US); David P. Fries, St. Petersburg, FL (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 09/514,782

(22) Filed: Feb. 25, 2000

Related U.S. Application Data

(63) Continuation-in-part of application No. 09/075,650, filed on May 11, 1998, now abandoned.

(51) Int. Cl.[7] ..... G01V 3/18

(52) U.S. Cl. ..... 250/255; 250/256; 250/259

(58) Field of Search ..... 250/255, 256, 250/259, 260, 261

(56) References Cited

U.S. PATENT DOCUMENTS 5,410,152 A * 4/1995 Gadeken ..... 250/260
5,892,147 A * 4/1999 Garnes et al. ..... 73/152.14

* cited by examiner

*Primary Examiner*—Constantine Hannaher
*Assistant Examiner*—Timothy Moran
(74) *Attorney, Agent, or Firm*—Vinson & Elkins L.L.P.

(57) ABSTRACT

Disclosed is a formation fluid analysis module which utilizes a down-hole mass spectrometer to determine the molecular constituents of formation fluids, as distinguished from drilling contaminants, and to provide information about the physical and chemical properties of the sample.

17 Claims, 1 Drawing Sheet

METHOD AND APPARATUS FOR THE DOWN-HOLE CHARACTERIZATION OF FORMATION FLUIDS

RELATED APPLICATION DATA

This application is a continuation-in-part of U.S. patent application Ser. No. 09/075,650, filed May 11, 1998 abandoned.

BACKGROUND OF THE INVENTION

1. Field of the Invention

The present invention relates to methods and apparatus for analyzing the subterranean. In another aspect, the present invention relates to methods of and apparatus for analyzing formation fluids and gases. In even another aspect, the present invention relates to distinguishing formation fluids and gases from drilling contaminates in methods of and apparatus for analyzing formation fluids and gases. In still another aspect, the present invention relates to utilizing mass spectroscopy in methods of and apparatus for analyzing formation fluids and gases. In yet another aspect, the present invention relates to methods and apparatus for analyzing formation fluids and gases, utilizing tags or markers in the well fluid. In even still another aspect, the present invention relates to methods and apparatus for analyzing formation fluids and gases, utilizing isotope tags or markers in the well fluid.

2. Description of the Related Art

Hydrocarbon exploration and data gathering of wells can be accomplished by utilizing wireline logs or logging while drilling tools (LWD) to obtain certain physical characteristics of a formation. Wireline logs require an umbilical (e.g. wireline, tool push-in, coiled tubing) from the surface to provide electrical power and are generally utilized after a well is drilled. LWDs are used to provide quantitative analysis of sub-surface formations during the actual drilling operation. LWDs typically include their own power source as the LWD string is an integral part of the bottom hole assembly and it would be impractical to connect an umbilical from the surface to provide electrical power or other requirements of the various LWD tools. The formation characteristics monitored by wireline logs and LWDs can include formation density, porosity, and water saturation. However, more detailed analysis would aid in characterization of a formation.

The analysis of the physical properties of the formation fluids, for example to determine relative amounts of oil, gas, and water, and the density, viscosity and compressibility of the fluid, is also of importance in determining the physical properties of a particular well.

However, the means of analysis of such formation fluids must be able to discriminate between the formation fluids and any drilling fluid components mixed with or intermingled with the formation fluids. For example, the hydrocarbon and/or water phases of the formation fluid may be contaminated with hydrocarbon and/or water components from the drilling fluid and/or mud filtrate.

For example, typically, the drilling fluids or muds will be either water or oil based. While oil base fluids are particularly useful in unconsolidated and water-susceptible formations, the hydrocarbons present in the drilling fluid may mask the formation fluids in the drilling mud returns, thus preventing the identification of formation hydrocarbons. Likewise, even when water based muds are used, diesel or other hydrocarbons may be added to aid in lubricating the drill bit, and likewise cause a similar masking of formation hydrocarbons. Furthermore, the water of the water based mud may mask the formation water phase, and cause a distortion of the formation hydrocarbon/water ratio.

The quantitative analysis of the constituents of the formation fluid distinguished from drilling fluids could be accomplished by the use of mass spectrometry which is a known analytical technique utilizing an instrument called a mass spectrometer.

A mass spectrometer generally consist of four components, an inlet system, an ion source, an analyzer, and a particle detector. Typical, unlimited examples of inlet systems include probe, chromatography or capillary electrophoresis. The ion source operates under high vacuum and employs some means of ionizing molecular samples. Typical ion sources bombard sample molecules with a high energy electron beam thereby shattering the sample into molecular and fragment ions. The analyzer separates the ions according to their mass to charge ratios. Typical analyzers include magnetic, quadrupole, ion trap, fourier transform and time of flight. The particle detector registers the intensity of the signal generated by the molecular and fragment ions. Non-limiting examples of suitable analyzers include channeltrons, electron multipliers, and microchannel plates.

Generally, in operation, a sample is introduced into a mass spectrometer and subject to ionization. The positive ions (molecular and fragment ions)are accelerated in a vacuum through a magnetic field or an electric field and sorted on the basis of mass to charge ratio (m/e). The highest molecular weight peak observed in a spectrum will typically represent the parent molecule minus an electron.

Present methods and apparatus require that a sample be removed from the well and analyzed by mass spectroscopy either at the well site or remote to it.

In some instances, no steps are taken to maintain the sample at the high pressures of the subterranean form which it was sampled, which may cause a phase change in part or all of the sample, and possibly skewing the results of any analysis. For while the sample may later be "repressurized," there may be hysteresis effects that come into play resulting in different composition results, or some or all of the sample may be "lost" through "venting" bringing it to the surface, and may skew the results.

In other instances, while steps are taken to maintain the sample at the high pressures of the subterranean from which it was sampled, at some point (i.e., as a non-limiting example, during transfer from the sample container to an analyzer) the sample pressure may be reduced, which again, may possibly skew the results of any analysis.

Furthermore, even with advanced spectrometry techniques, it is still sometimes difficult to distinguish in the sample, contributions by formation fluids from contributions by drilling fluids.

Therefore, there is still a need for a method and apparatus to perform more detailed down-hole analysis of formation fluids.

There is another need in the art for a method and apparatus to perform more detailed down-hole analysis of formation fluids which can distinguish between formation fluids and drilling contaminants.

There is even another need in the art for a method and apparatus to perform more detailed down-hole realtime analysis of formation fluids which can distinguish between formation fluids and drilling contaminants.

These and other needs in the art will become apparent to those of skill in the art upon review of this specification, including its drawings and claims.

SUMMARY OF THE INVENTION

It is an object of the present invention to provide for a method and apparatus to perform more detailed down-hole analysis of formation fluids.

It is another object of the present invention to provide for a method and apparatus to perform more detailed down-hole analysis of formation fluids which can distinguish between formation fluids and drilling contaminants.

It is even another object of the present invention to provide for a method and apparatus to perform more detailed down-hole realtime analysis of formation fluids which can distinguish between formation fluids and drilling contaminants.

These and other objects of the present invention will become apparent to those of skill in the art upon review of this specification, including its drawings and claims.

According to one embodiment of the present invention there is provided an analysis module designed to be positioned in a well bore which includes a sampler system and a mass spectrometer.

According to another embodiment of the present invention there is provided a method for analyzing formation fluids which includes the steps of: positioning a mass spectrometer in a well bore; obtaining a sample of formation fluid; introducing the sample into the mass spectrometer; and processing the data received from the mass spectrometer to determine the molecular constituents of the formation fluid.

According to even another embodiment of the present invention, there is provided a method for analyzing well bore fluids. The well bore fluids generally include well fluids added to the well bore and formation fluids from the subterranean formation. The method generally includes adding an isotrope marker or tag to a fluid to form a well fluid. The method next includes contacting in the well bore, the well fluid with the formation fluid. The method also includes analyzing the well bore fluid to determine the components of the formation fluid.

According to still another embodiment of the present invention, there is provided a method for analyzing well bore fluids in a well bore. The method generally include positioning a mass spectrometer in the well bore. The s method also includes sampling the well bore fluids, and then analyzing the well bore fluids with the mass spectrometer.

According to yet another embodiment of the present invention, there is provided an apparatus positioned in a well bore penetrating the subterranean. The apparatus includes a drilling string or umbilical, positioned in the well bore, and extending from the surface into the subterranean. The apparatus also includes a sonde positioned in the well bore, and supported by the drilling string or umbilical, wherein the sonde comprises a mass spectrometer.

These and other embodiments of the present invention will become apparent to those of skill in the art upon review of this specification, including its drawings and claims.

DETAILED DESCRIPTION OF THE INVENTION

The present invention provides a module for the analysis of formation fluid and gas constituents. The purpose of the device is to. acquire data down-hole capable of determining the atomic and molecular constituents of the sample. This information is used to discriminate among hydrocarbons, determine water salinity, determine oil-water-gas volume fractions, and discriminate between drilling fluids and formation fluids and gases.

Figure 1:
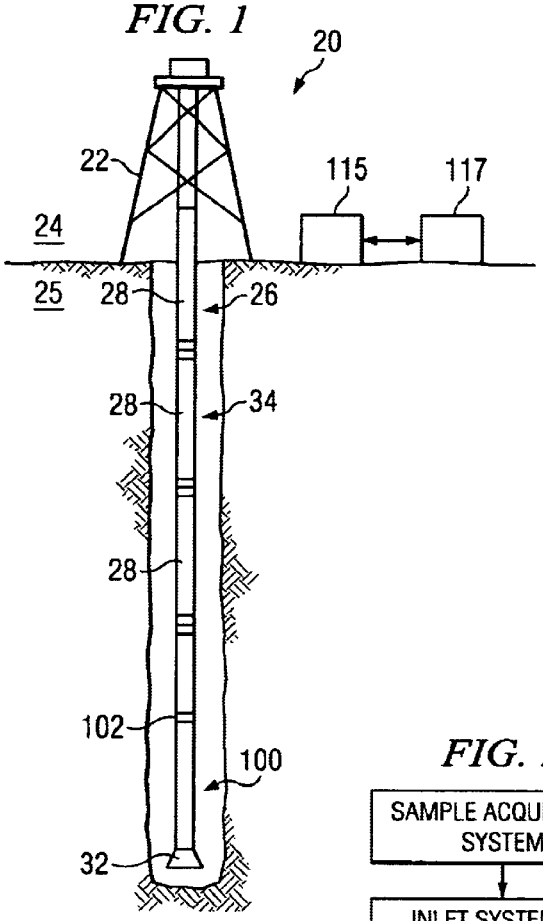
FIG. 1 is an illustration of a typical drilling operation showing drilling rig 20 and analysis module or logging sonde 100.

Referring now to the figures, FIG. 1 is an illustration of a typical drilling operation showing drilling rig 20 and analysis module or logging sonde 100. Drilling rig 20 is generally a rotary drilling rig which is well known in the drilling art and comprises mast 22 which rises above ground 24. Rotary drilling rig 20 is fitted with lifting gear from which is suspended a drill string 26 formed by a multiplicity of drill pipes 28 screwed into one another having at its lower end a drill bit 32 for the purpose of drilling a well bore 34.

In addition to logging while drilling, module or sonde 100 of the present invention may also be utilized in exploratory logging (i.e., of an open hole), production logging (i.e., of a cased hole), and permanent logging.

Drilling mud is injected into well bore 34 via the hollow drill pipes 28 of drill string 26. The drilling mud is generally drawn from a mud pit which may be fed with surplus mud from the well bore 34.

The analysis module or logging sonde 100 is located in drill string 26 (or alternatively may be supported by an umbilical) in any suitable location and by any suitable manner known to those in the art including by coupling 102 as shown in FIG. 1. of course, analysis, module 100 may be utilized as a stand alone well logging sonde, or may incorporated with other logging instruments in a multi-purpose or multi-task well logging sonde.

Figure 3:
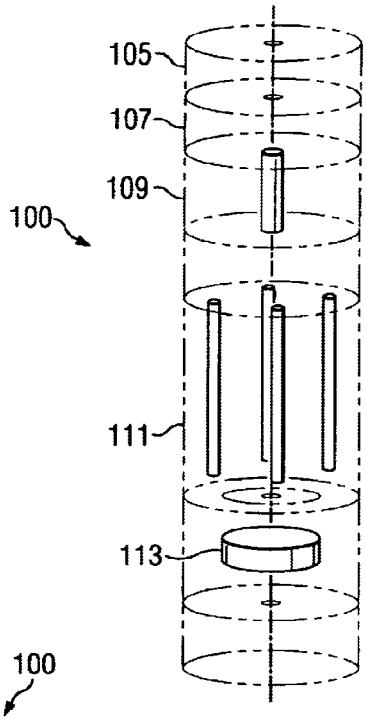
FIG. 3 is a illustration of the analysis module or logging sonde 100 of the present invention shown generally to include sample acquisition system 105, inlet system of a down-hole mass spectrometer 107, ionization source 109, quadripole analyzer 111 and particle detector 113.
Figure 2:
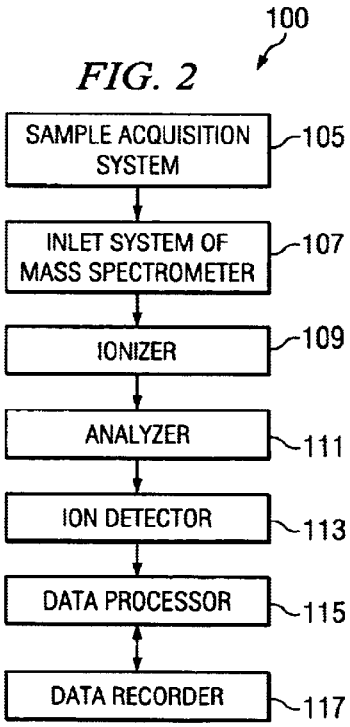
FIG. 2 is a flow chart showing the operation of analysis module or logging sonde 100 shown generally to include sample acquisition system 105, inlet system of a down hole mass spectrometer 107, ionizer 109, analyzer 111, ion detector 113, data processor 115 and data recorder 117.

Referring now to FIGS. 2 and 3, which are a flow chart and an illustration of analysis module or logging sonde 100 of the present invention respectively. While module 100 is shown generally to include sample acquisition system 105, inlet system of a down-hole mass spectrometer 107, ionizer 109, analyzer 111, ion detector 113, data processor 115 and data recorder 117, it may also include fewer than. all of these components. Preferably, module or sonde 100 will include at least the basic four components of a mass spectrometer, that is, inlet system 107, ionizer 109, analyzer 111, and ion detector 113.

Of course, well logging sonde 100 must be capable operating in the high pressures of the subterranean at the depths at which it will be operating. Thus, module or sonde 100 will have a housing suitable for withstanding the pressures of the operating depth.

Acquisition system 105 extracts fluid samples from the formation by methods known in the art. Sample acquisition system 105 optionally includes a filter or other means, such as settling, centrifuging, and vaporization, to remove particulate matter from the sample. In addition to a particulate filter, component specific filters may be utilized to remove water or selected organic materials from the sample. Sample acquisition system 105 could also include a known trap and desorb system. It is also to be understood that the sampling system 105 may contain a splitter which will transport one portion of the sample to a purification and/or filtration train for example, and another portion to a second purification train, a second filtration train, a second type of analyzer, or reserved for later analysis. Sampling may occur continuously or at selective intervals.

Once acquired, the sample will be introduced into sample inlet system 107 of a down-hole mass spectrometer comprising inlet system 107, ionizer 109, analyzer 111, and ion detector 113. The down-hole mass spectrometer of the present invention must be of a suitable physical dimensions to be utilized in the confines of well bore 34. Non-limiting examples of current instrumentation that suggest this requirement is attainable include the Residual Gas Analyzer produced by Stanford Research Systems and the Transportable Mass Spectrometer T-CAT produced by Kore Technology Limited.

In addition to the physical dimensions, the mass spectrometer must be capable of operation at the temperature and pressure conditions existing at the well bore depth at which it is operating. As non-limiting examples of conditions that might be encountered, include temperatures between about 0° F. and about 350° F, and pressures between about 15 PSI and about 15 KSI. Of course, given the particular operating depth, higher or lower conditions might be encountered.

The electrical power source for the present invention may be provided by a wireline from the surface. If an umbilical is impractical, the power source may be located in analysis module 100 or otherwise be positioned down-hole as long as the power source is of suitable physical dimensions to be utilized in the confines of well bore 34. Non-limiting examples of down-hole power supplies for module 100 could include a battery system or a down-hole turbine/alternator power supplies as known in the art.

The vacuum source for the present invention may be provided by an umbilical from the surface. If an umbilical is impractical, the vacuum source may be located in analyzer module 100 or otherwise positioned down-hole. The vacuum source of the present invention, if positioned down-hole, must be of suitable physical dimensions to be utilized in the confines of well bore 34.

The vacuum source of the present invention must be capable of performing reliably in the high pressures encountered down-hole. Non-limiting examples of suitable systems include ion pumps, getters, and static systems (no active pumping down-hole) or systems which incorporate a sealed exhaust chamber for the pump. Such systems consist of a previously evacuated volume attached either to the mass spectrometer via a capillary equipped with a gating valve or to the exhaust port of a vacuum pump. In the first case, the evacuated volume is allowed to draw on the mass spectrometer volume in order to maintain sufficient vacuum for operation. Another non-limiting example of a vacuum system for the present invention is a pressure gradient system which ultimately exhausts to the bore hole. If coiled tube or drill pipe or tool pusher is used to convey the device, the vacuum may be exhausted to the empty annulus.

The inlet system 107 of the down-hole mass spectrometer of the present invention may be any inlet system 107 necessary to introduce the sample into the ionizer 109. The type of inlet system 107 utilized will be determined by the particular sample. It is to be understood that more than one inlet system 107 may be incorporated. Non-limiting examples of inlet systems 107 include solids probe, desorption unit, or membrane assemblies. In the case of sample mixtures, chromatography may be utilized in inlet system 107 if some separation of a mixture's components is desired prior to the sample's introduction into the ionizer 109.

The sample is ionized in ion source 109 of the present invention. Ionization of the sample into molecular fragment and elemental ions may be accomplished by any conventional ionization technique. Non-limiting examples of ionization techniques include electron emitting filaments, electro spray sources, and Penning sources. After ionization, the molecular and fragment ions enter analyzer 111.

Analyzer 111 determines the mass to charge ratios (m/e) of the molecular and fragment ions. The analyzer 111 may be any analyzer known in the art. Non-limiting examples of types of mass spectrometer analyzers that can be used in the present invention include magnetic, quadrupole, ion trap, fourier transform, and time of flight.

Ion detector 113 may be any detector capable of performing in the elevated temperature conditions that exist down-hole. Non-limiting examples of types of detector 113 include channeltrons, electron multipliers and microchannel plates.

Referring again to FIG. 1, the data received from the analysis module 100 are then processed, by data processor 115 at the well site, and/or simultaneously recorded by recorder 117 for data processing off site, to determine the character of the formation fluid sampled. Preferably, data processor 115 and recorder 117 are a computer with sufficient memory. It is to be understood that data processor 115 may receive data from input sources in addition to the analyzer module of the present invention. It must also be understood that recorder 117 may be any suitable recording device for recording data including tape, diskette, CD, hard drive and the like. Non-limiting examples of other such data include drill bit depth, sampling location, temperature, pressure and mass flow rate.

As is well known in the art, the data processor 115 compares the mass spectra of the samples obtained by analyzer module 100 to the spectra of standards, prepared of known constituents of known concentrations, or to a database containing a spectrum library in order to determine the molecular constituents of the sample. Software for the analysis of the mass spectra of mixtures may be purchased commercially or developed specifically for the application.

In operation, the analysis module of the present invention is positioned in the borehole at the proper location to analyze the desired section of the formation. A sample is then acquired, filtered, for particulate matter or compounds, or otherwise processed or stored as desired. The sample, is then introduced into the mass spectrometer inlet, ionized and the m/e is determined.

The sample signal is simultaneously processed and or recorded. The sample spectra is then compared to the spectra of known analytes of known concentrations. From the relative intensities of the m/e of the standard and of the sample the concentrations of the sample's individual components are determined.

To further aid in distinguishing the formation fluids from the well fluids, a marker or tag may be provided with the well fluid. The relative concentration of this marker or tag in the sample, will provide an estimate of the amount of contribution the well fluid has made toward the sample. Knowing the sample composition, the well fluid composition, and the relative contribution of the well fluid to the sample, the formation fluid composition may easily be determined.

The present invention includes the use as a tag of an isotope that chemically behaves like or similar to one of the well fluid components, that may be readily distinguished in the mass spectrometry.

For example, most commonly, this would include replacement of one or more atoms of hydrogen, carbon or oxygen of one or more of the well fluid components with an isotope will provide an sufficient marker. For example replacing one or more of the atoms of water or a complex hydrocarbon in the well fluid with an isotope. As a specific and preferred example, the use of deuterium as part of or all of the water component of the well fluid.

In the operation of a well having a well bore, in which there is present in the well bore fluids both formation fluids and added well fluids, the method of the present invention would include providing a tag or maker to well fluids prior to the addition of the well fluids to the well bore, obtaining a sample of well bore fluid, and analyzing the well bore fluid to determine the composition of the formation fluid. Preferably, the tag or maker is an isotopic marker, more preferably, deuterium. Also preferably, the analysis of the sample would be utilizing a mass spectrometer, and more preferably by utilizing a mass spectrometer positioned in the well bore, even more preferably, positioned in the well bore at or near the sample depth.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which this invention pertains.

We claim:

1. An analysis module designed to be positioned in a well bore comprising:

(a) a logging sonde;

(b) a sampler system supported by the sonde; and (c) a mass spectrometer supported by the logging sonde and sized to be positioned in the well bore to receive a sample having sample components from the sampler system;

wherein the mass spectrometer analyzes the sample by ionizing the sample into molecular ions and fragment ions, sorting the molecular ions and fragment ions on the basis of mass to charge ratio (m/e) and producing a spectrum unique to the sample components.

2. The analysis module of claim 1 wherein the sampler system further comprises:

(d) a drill string or umbilical affixed to the sonde.

3. The analysis module of claim 1 wherein the module further comprises:

(d) a vacuum source.

4. The analysis module of claim 1 wherein the module further comprises:

(d) an electrical power source.

5. A method for analyzing formation fluids comprising:

(a) positioning a logging sonde comprising a mass spectrometer in a well bore;

(b) obtaining a sample, having sample components, of fluid from the well bore and formation; and (c) introducing the sample into the mass spectrometer positioned in the well bore.

6. The method of claim 5 wherein a particulate matter removal means removes particulate matter from the sample prior to introducing the sample into the mass spectrometer.

7. The method of claim 6, wherein the particulate removal means includes a filter.

8. The method of claim 5 wherein the mass spectrometer further includes a vacuum source.

9. The method of claim 5 wherein the mass spectrometer further includes an electrical power source.

10. A method for analyzing fluids from a subterranean formation, the fluids comprising well fluids added to a well bore and formation fluids from the subterranean formation, the method comprising:

(a) adding to the well fluids an isotope that is not naturally occurring in the subterranean formation and the formation fluids;

(b) contacting in the well bore, the formation fluids potentially contaminated by the well fluids;

(c) obtaining a sample of the fluids from the subterranean formation;

(d) determining a relative contribution of the well fluids present in the sample by screening the sample for the isotope, wherein the well fluids are distinguished from the formation fluids by the presence of the isotope, and the relative contribution of the well fluids is determined by the concentration of the isotope present in the sample;

(e) in view of the relative contribution of the well fluids present in the sample analyzing the sample to determine a composition of the formation fluids.

11. The method of claim 10, wherein the analyzing of step (d) includes utilizing a mass spectrometer.

12. The method of claim 10, wherein the analyzing of step (d) includes utilizing a mass spectrometer positioned in the well bore.

13. The method of claim 10, wherein the isotope includes deuterium.

14. A method for analyzing fluids in a well bore, the method comprising:

(a) positioning a mass spectrometer in the well bore;

(b) sampling the fluids;

(c) analyzing the fluids with the mass spectrometer.

15. An apparatus positioned in a well bore penetrating a subterranean formation, the apparatus comprising:

(a) a drilling string, positioned in the well bore, extending from the surface into the subterranean;

(b) a sonde positioned in the well bore, and supported by the drilling string, wherein the sonde comprises a mass spectrometer.

16. The apparatus of claim 15, further comprising an umbilical positioned in the well bore.

17. The apparatus of claim 16, wherein the umbilical supports the sonde positioned in the well bore.

* * * * *